US006443216B1

(12) United States Patent
Lombard et al.

(10) Patent No.: US 6,443,216 B1
(45) Date of Patent: Sep. 3, 2002

(54) THERMAL JACKET FOR A VESSEL

(75) Inventors: Patrick J. Lombard; Shaupoh Wang, both of Jackson, TN (US)

(73) Assignee: AEMP Corporation, Jackson, TN (US)

( * ) Notice: Subject to any disclaimer, the term of this patent is extended or adjusted under 35 U.S.C. 154(b) by 0 days.

(21) Appl. No.: 09/584,859

(22) Filed: Jun. 1, 2000

(51) Int. Cl.[7] ..... B22D 41/005; C21B 7/02

(52) U.S. Cl. ..... 164/335; 164/338.1; 164/348; 266/275; 266/286

(58) Field of Search ..... 164/418, 485, 164/459, 443, 455, 338.1, 348, 373, 335, 336, 337; 266/280, 286, 275, 241, 46, 237, 234

(56) References Cited

U.S. PATENT DOCUMENTS

| | | | | | |
|---|---|---|---|---|---|
| 972,429 | A | * | 10/1910 | Baird | 266/241 |
| 1,506,281 | A | * | 8/1924 | Baily | 266/280 |
| 1,776,355 | A | * | 9/1930 | Eppensteiner | 266/280 |
| 3,472,502 | A | * | 10/1969 | Schott | 266/27 |
| 3,791,015 | A | * | 2/1974 | Lucenti | 29/401 |
| 3,981,351 | A | * | 9/1976 | Dompass | 164/283 |
| 4,088,295 | A | * | 5/1978 | Medovar et al. | 249/79 |
| 4,774,992 | A | * | 10/1988 | George | 164/122.1 |
| 5,247,988 | A | * | 9/1993 | Kurzinski | 164/485 |
| 5,332,200 | A | * | 7/1994 | Gorin et al. | 266/280 |
| 5,416,795 | A | * | 5/1995 | Kaniuk et al. | 373/155 |
| 5,425,048 | A | * | 6/1995 | Heine et al. | 373/151 |
| 5,501,266 | A | * | 3/1996 | Wang et al. | 164/113 |
| 5,781,581 | A | * | 7/1998 | Fishman et al. | 373/152 |
| 5,887,640 | A | | 3/1999 | Brown et al. | 164/133 |

FOREIGN PATENT DOCUMENTS

| | | | |
|---|---|---|---|
| JP | 61-67555 | * | 4/1986 |
| JP | 6-28939 | * | 2/1994 |

* cited by examiner

*Primary Examiner*—M. Alexandra Elve
*Assistant Examiner*—Len Tran
(74) *Attorney, Agent, or Firm*—Woodard, Emhardt, Naughton, Moriarity & McNett

(57) ABSTRACT

An apparatus for and method of controlling the cooling rate of a metallic melt in the production of a semi-solid slurry billet for use in a casting process. The apparatus comprises a thermal jacket including symmetrical halves, with each half having a rounded heat transfer surface extending between a pair of longitudinal edges. An actuator mechanism engages the heat transfer surfaces into intimate contact with a vessel containing the metallic melt to effectuate conductive heat transfer between the vessel and the thermal jacket, with the pairs of longitudinal edges of each halve being disposed in a generally opposite, spaced relationship. The thermal jacket includes a plurality of passageways adapted to carry cooling air for extracting heat from the metallic melt, and a plurality of electric heating elements for adding heat to the metallic melt. The cooling rate of the metallic melt is controlled within a range of about 0.1 degrees Celsius per second to about 10 degrees Celsius per second by regulating the flow of cooling air through the passageways and by regulating activation of the heating elements. The thermal jacket includes fluid manifolds disposed at opposite ends of the thermal jacket to distribute and direct the flow of cooling air, and a plurality of exhaust ports extending between each of the passageways to an exterior surface of the thermal jacket to discharge heat laden cooling air in a lateral direction.

31 Claims, 6 Drawing Sheets

THERMAL JACKET FOR A VESSEL

BACKGROUND OF THE INVENTION

The present invention relates in general to an apparatus constructed and arranged for producing an "on-demand" semi-solid material for use in a casting process. Included as part of the overall apparatus are various stations which have the requisite components and structural arrangements which are to be used as part of the process. The method of producing the on-demand semi-solid material, using the disclosed apparatus, is included as part of the present invention.

More particularly, one embodiment of the present invention relates to a thermal jacket for engaging the exterior of a forming vessel containing molten metal to control the heating/cooling rate of the molten metal during the semi-solid material forming process. Although the present invention was developed for use in the semi-solid forming of metals or metal alloys, certain applications of the invention may fall outside of this field.

The present invention incorporates electromagnetic stirring and various temperature control and cooling control techniques and apparata to facilitate the production of the semi-solid material within a comparatively short cycle time. Also included are structural arrangements and techniques to discharge the semi-solid material directly into a casting machine shot sleeve. As used herein, the concept of "on-demand" means that the semi-solid material goes directly to the casting step from the vessel where the material is produced. The semi-solid material is typically referred to as a "slurry" and the slug which is produced as a "single shot" is also referred to as a billet. These terms have been combined in this disclosure to represent a volume of slurry which corresponds to the desired single shot billet.

Semi-solid forming of light metals for net-shape and near-net shape manufacturing can produce high strength, low porosity components with the economic cost advantages of die-casting. However, the semi-solid molding (SSM) process is a capital-intensive proposition tied to the use of metal purchased as pre-processed billets or slugs.

Parts made with the SSM process are known for high quality and strength. SSM parts compare favorably with those made by squeeze casting, a variation of die-casting that uses large gate areas and a slow cavity fill. Porosity is prevented by slow, non-turbulent metal velocities (gate velocities between 30 and 100 in./sec.) and by applying extreme pressure to the part during solidification. Both squeeze casting and SSM processes produce uniformly dense parts that are heat-treatable.

SSM offers the process economics of die casting and the mechanical properties that approach those of forgings. In addition, SSM capitalizes on the non-dendritic microstructure of the metal to produce parts of high quality and strength. SSM can cast thinner walls than squeeze casting due to the globular alpha grain structure, and it has been used successfully with both aluminum and magnesium alloys. SSM parts are weldable and pressure tight without the need for impregnation under extreme pressure that characterizes the squeeze-cast process.

The SSM process has been shown to hold tighter dimensional capabilities than any other aluminum molding process. That has intensified demand for SSM components due to the potential for significant cost savings, reduction of machining, and quicker cycle times for higher production rates. Besides high strength and minimal porosity, SSM parts exhibit less part-to-die shrinkage than die cast parts and very little warpage. It produces castings that are closer to the desired net shape, which reduces and can even eliminate secondary machining operations. Surface finishes on the castings are often better than the iron and steel parts they replace.

The SSM process requires higher final mold pressure (15,000 to 30,000 psi) than conventional die casting (7,000 to 12,000 psi), but modern die casting equipment provides the flexibility needed to produce SSM parts efficiently and economically. Real-time, closed-loop hydraulic circuits incorporated into today's die casting machines can automatically maintain the correct fill velocities of the SSM material alloy. Closed-loop process control systems monitor metal temperature and time, voltage feedback from electrical stator and other data to provide a very robust and precisely controlled operation that can maximize productivity of high quality parts and ensure reproducibility.

As described, it is well known that semi-solid metal slurry can be used to produce products with high strength and low porosity at net shape or near net shape. However, the viscosity of semi-solid metal is very sensitive to the slurry's temperature or the corresponding solid fraction. In order to obtain good fluidity at high solid fraction, the primary solid phase of the semi-solid metal should be nearly spherical.

In general, semi-solid processing can be divided into two categories; thixocasting and rheocasting. In thixocasting, the microstructure of the solidifying alloy is modified from dendritic to discrete degenerated dendrite before the alloy is cast into solid feedstock, which will then be re-melted to a semi-solid state and cast into a mold to make the desired part. In rheocasting, liquid metal is cooled to a semi-solid state while its microstructure is modified. The slurry is then formed or cast into a mold to produce the desired part or parts.

The major barrier in rheocasting is the difficulty to generate sufficient slurry within preferred temperature range in a short cycle time. Although the cost of thixocasting is higher due to the additional casting and remelting steps, the implementation of thixocasting in industrial production has far exceeded rheocasting because semi-solid feedstock can be cast in large quantities in separate operations which can be remote in time and space from the reheating and forming steps.

In a semi-solid casting process, generally, a slurry is formed during solidification consisting of dendritic solid particles whose form is preserved. Initially, dendritic particles nucleate and grow as equiaxed dendrites within the molten alloy in the early stages of slurry or semi-solid formation. With the appropriate cooling rate and stirring, the dendritic particle branches grow larger and the dendrite arms have time to coarsen so that the primary and secondary dendrite arm spacing increases. During this growth stage in the presence of stirring, the dendrite arms come into contact and become fragmented to form degenerate dendritic particles. At the holding temperature, the particles continue to coarsen and become more rounded and approach an ideal spherical shape. The extent of rounding is controlled by the holding time selected for the process. With stirring, the point of "coherency" (the dendrites become a tangled structure) is not reached. The semi-solid material comprised of fragmented, degenerate dendrite particles continues to deform at low shear forces. The present invention incorporates apparata and methods in a novel and unobvious manner which utilize the metallurgical behavior of the alloy to create a suitable slurry within a comparatively short cycle time.

When the desired fraction solid and particle size and shape have been attained, the semi-solid material is ready to be formed by injecting into a die-mold or some other forming process. Silicon particle size is controlled in the process by limiting the slurry creation process to temperatures above the point at which solid silicon begins to form and silicon coarsening begins.

It is known that the dendritic structure of the primary solid of a semi-solid alloy can be modified to become nearly spherical by introducing the following perturbation in the liquid alloy near liquidus temperature or semi-solid alloy:

1) Stirring: mechanical stirring or electromagnetic stirring;
2) Agitation: low frequency vibration, high-frequency wave, electric shock, or electromagnetic wave;
3) Equiaxed Nucleation: rapid under-cooling, grain refiner;
4) Oswald Ripening and Coarsening: holding alloy in semi-solid temperature for a long time.

While the methods in (2)–(4) have been proven effective in modifying the microstructure of semi-solid alloy, they have the common limitation of not being efficient in the processing of a high volume of alloy with a short preparation time due to the following characteristics or requirements of semi-solid metals:

High dampening effect in vibration.

Small penetration depth for electromagnetic waves.

High latent heat against rapid under-cooling.

Additional cost and recycling problem to add grain refiners.

Natural ripening takes a long time, precluding a short cycle time.

While most of the prior art developments have been focused on the microstructure and rheology of semi-solid alloy, temperature control has been found by the present inventors to be one of the most critical parameters for reliable and efficient semi-solid processing with a comparatively short cycle time. As the apparent viscosity of semi-solid metal increases exponentially with the solid fraction, a small temperature difference in the alloy with 40% or higher solid fraction results in significant changes in its fluidity. In fact, the greatest barrier in using methods (2)–(4), as listed above, to produce semi-solid metal is the lack of stirring. Without stirring, it is very difficult to make alloy slurry with the required uniform temperature and microstructure, especially when the there is a requirement for a high volume of the alloy. Without stirring, the only way to heat/cool semi-solid metal without creating a large temperature difference is to use a slow heating/cooling process. Such a process often requires that multiple billets of feedstock be processed simultaneously under a pre-programmed furnace and conveyor system, which is expensive, hard to maintain, and difficult to control.

While using high-speed mechanical stirring within an annular thin gap can generate high shear rate sufficient to break up the dendrites in a semi-solid metal mixture, the thin gap becomes a limit to the process's volumetric throughput. The combination of high temperature, high corrosion (e.g. of molten aluminum alloy) and high wearing of semi-solid slurry also makes it very difficult to design, to select the proper materials and to maintain the stirring mechanism.

Prior references disclose the process of forming a semi-solid slurry by reheating a solid billet, formed by thixocasting, or directly from the melt using mechanical or electromagnetic stirring. The known methods for producing semi-solid alloy slurries include mechanical stirring and inductive electromagnetic stirring. The processes for forming a slurry with the desired structure are controlled, in part, by the interactive influences of the shear and solidification rates.

In the early 1980's, an electromagnetic stirring process was developed to cast semi-solid feedstock with discrete degenerate dendrites. The feedstock is cut to proper size and then remelt to semi-solid state before being injected into mold cavity. Although this magneto hydrodynamic (MHD) casting process is capable of generating high volume of semi-solid feedstock with adequate discrete degenerate dendrites, the material handling cost to cast a billet and to remelt it back to a semi-solid composition reduces the competitiveness of this semi-solid process compared to other casting processes, e.g. gravity casting, low-pressure die-casting or high-pressure die-casting. Most of all, the complexity of billet heating equipment, the slow billet heating process and the difficulties in billet temperature control have been the major technical barriers in semi-solid forming of this type.

The billet reheating process provides a slurry or semi-solid material for the production of semi-solid formed (SSF) products. While this process has been used extensively, there is a limited range of castable alloys. Further, a high fraction of solids (0.7 to 0.8) is required to provide for the mechanical strength required in processing with this form of feedstock. Cost has been another major limitation of this approach due to the required processes of billet casting, handling, and reheating as compared to the direct application of a molten metal feedstock in the competitive die and squeeze casting processes.

In the mechanical stirring process to form a slurry or semi-solid material, the attack on the rotor by reactive metals results in corrosion products that contaminate the solidifying metal. Furthermore, the annulus formed between the outer edge of the rotor blades and the inner vessel wall within the mixing vessel results in a low shear zone while shear band formation may occur in the transition zone between the high and low shear rate zones. There have been a number of electromagnetic stirring methods described and used in preparing slurry for thixocasting billets for the SSF process, but little mention has been made of an application for rheocasting.

The rheocasting, i.e., the production by stirring of a liquid metal to form semi-solid slurry that would immediately be shaped, has not been industrialized so far. It is clear that rheocasting should overcome most of limitations of thixocasting. However, in order to become an industrial production technology, i.e., producing stable, deliverable semi-solid slurry on-line (i.e., on-demand) rheocasting must overcome the following practical challenges: cooling rate control, microstructure control, uniformity of temperature and microstructure, the large volume and size of slurry, short cycle time control and the handling of different types of alloys, as well as the means and method of transferring the slurry to a vessel and directly from the vessel to the casting shot sleeve.

One of the ways to overcome above challenges, according to the present invention, is to apply electromagnetic stirring of the liquid metal when it is solidified into semi-solid ranges. Such stirring enhances the heat transfer between the liquid metal and its container to control the metal temperature and cooling rate, and generates the high shear rate inside of the liquid metal to modify the microstructure with discrete degenerate dendrites. It increases the uniformity of metal temperature and microstructure by means of the molten metal mixture. With a careful design of the stirring mechanism and method, the stirring drives and controls a large volume and size of semi-solid slurry, depending on the application requirements. The stirring helps to shorten the cycle time by controlling the cooling rate, and this is applicable to all type of alloys, i.e., casting alloys, wrought alloys, MMC, etc.

While propeller type mechanical stirring has been used in the context of making a semi-solid slurry, there are certain problems or limitations. For example, the high temperature and the corrosive and high wearing characteristics of semi-solid slurry, makes it very difficult to design a reliable slurry apparatus with mechanical stirring. However, the most critical limitation of using mechanical stirring in rheocasting is that its small throughput cannot meet the requirements production capacity. It is also known that semi-solid metal with discrete degenerated dendrite can also be made by introducing low frequency mechanical vibration, high-frequency ultra-sonic waves, or electric-magnetic agitation with a solenoid coil. While these processes may work for smaller samples at slower cycle time, they are not effective in making larger billet because of the limitation in penetration depth. Another type of process is solenoidal induction agitation, because of its limited magnetic field penetration depth and unnecessary heat generation, it has many technological problems to implement for productivity. Vigorous electromagnetic stirring is the most widely used industrial process permits the production of a large volume of slurry. Importantly, this is applicable to any high-temperature alloys. is the most widely used industrial process permits the production of a large volume of slurry. Importantly, this is applicable to any high-temperature alloys.

Two main variants of vigorous electromagnetic stirring exist, one is rotational stator stirring, and the other is linear stator stirring. With rotational stator stirring, the molten metal is moving in a quasi-isothermal plane, therefore, the degeneration of dendrites is achieved by dominant mechanical shear. U.S. Pat. No. 4,434,837, issued Mar. 6, 1984 to Winter et al., describes an electromagnetic stirring apparatus for the continuous making of thixotropic metal slurries in which a stator having a single two pole arrangement generates a non-zero rotating magnetic field which moves transversely of a longitudinal axis. The moving magnetic field provides a magnetic stirring force directed tangentially to the metal container, which produces a shear rate of at least 50 $sec^{-1}$ to break down the dendrites. With linear stator stirring, the slurries within the mesh zone are re-circulated to the higher temperature zone and remelted, therefore, the thermal processes play a more important role in breaking down the dendrites. U.S. Pat. No. 5,219,018, issued Jun. 15, 1993 to Meyer, describes a method of producing thixotropic metallic products by continuous casting with polyphase current electromagnetic agitation. This method achieves the conversion of the dendrites into nodules by causing a refusion of the surface of these dendrites by a continuous transfer of the cold zone where they form towards a hotter zone.

A part formed according to this invention will typically have equivalent or superior mechanical properties, particularly elongation, as compared to castings formed by a fully liquid-to-solid transformation within the mold, the latter castings having a dendritic structure characteristic of other casting processes.

With specific regard to the embodiment of the present invention relating to the thermal jacket, in the art of casting, it is common to transfer molten metal to a forming vessel or crucible where it is completely or at least partially solidified. A heating/cooling system is sometimes provided to progressively impart or extract thermal energy during solidification of the molten metal. The heating/cooling system serves to control the solidification rate by regulating the temperature of the molten metal, thereby allowing the molten metal to cool at a controlled rate until the desired temperature and material solidity are reached.

Considerations in the design of a suitable heating/cooling system include its capacity to uniformly add and/or remove heat from the metal, as well as its ability to control the temperature of the metal throughout the solidification process. The system should also have sufficient thermal capacity to dissipate heat quickly to the environment to shorten cycle times and increase volumetric output. Additionally, the removal or addition of heat should be as uniform as possible. Further, because the solidification process is highly sensitive to changes in temperature and cooling rates of the molten metal, the system should be capable of accurately and automatically controlling each of these parameters.

Heretofore, there has been a need for a thermal jacket for use in the semi-solid forming of metals or metal alloys that addresses at least some of the considerations discussed above. An effective means for satisfying this need has escaped those skilled in the art. The present invention satisfies this need in a novel and unobvious way.

SUMMARY OF THE INVENTION

One form of the present invention contemplates an apparatus for controlling the temperature of a metallic melt, comprising a vessel for containing the metallic melt and a thermal jacket having a first portion defining a first surface extending between a first pair of axial edges, and a second portion defining a second surface extending between a second pair of axial edges. The first and second surfaces are each engaged in intimate contact with the vessel to effectuate conductive heat transfer between the vessel and the thermal jacket, with the first pair of axial edges being disposed generally opposite the second pair of axial edges. In a further aspect of the invention, a gap exists between the first pair of axial edges and the second pair of axial edges when the first and second surfaces are engaged in intimate contact with the vessel.

In another form of the present invention, an apparatus is provided for controlling the cooling rate of a metallic melt, comprising a vessel containing the metallic melt and a thermal jacket in thermal communication with the vessel. The thermal jacket includes means for controlling the cooling rate of the metallic melt within a range of about 0.1 degrees Celsius per second to about 10 degrees Celsius per second.

In a further form of the present invention, an apparatus is provided for controlling the temperature of a metallic melt, comprising a vessel containing the metallic melt, a thermal jacket including a first portion defining a first surface and a second portion defining a second surface, and an actuator for positioning the first and second portions of the vessel in intimate contact with the vessel.

In still another form of the present invention, a thermal jacket is provided, comprising a body portion defining a plurality of first passageways for directing a fluid in a first flow direction, and a plurality of second passageways for directing the fluid in a second flow direction generally opposite the first flow direction. A manifold having a plurality of fluid paths positioned in fluid communication with corresponding pairs of the first and second passageways to redirect the fluid from the first flow direction to the second flow direction.

In yet another form of the present invention, a thermal jacket is provided, comprising a body portion defining a plurality of passageways adapted to transfer a fluid therethrough, and a fluid distribution manifold having a fluid path positioned in fluid communication with the passageways to distribute fluid to each of the passageways.

In another form of the present invention, a thermal jacket is provided, comprising a wall having an exterior surface extending along an axis, a plurality of passageways extending at least partially through the wall and adapted to transport a fluid therethrough, and a plurality of openings extending from the exterior surface and in fluid communication with respective ones of the passageways to discharge the fluid in a direction transverse to the axis.

In still another form of the present invention, a method is provided for controlling the cooling rate of a metallic melt, comprising providing a vessel and a thermal jacket, introducing the metallic melt into the vessel, placing the thermal jacket in thermal communication with the vessel, effectuating heat transfer between the vessel and the thermal jacket, and controlling the cooling rate of the metallic melt within a range of about 0.1 degrees Celsius per second to about 10 degrees Celsius per second.

Further forms, embodiments, objects, features, advantages, benefits, and aspects of the present invention shall become apparent from the drawings and descriptions provided herein.

DESCRIPTION OF THE PREFERRED EMBODIMENTS

Figure 1:
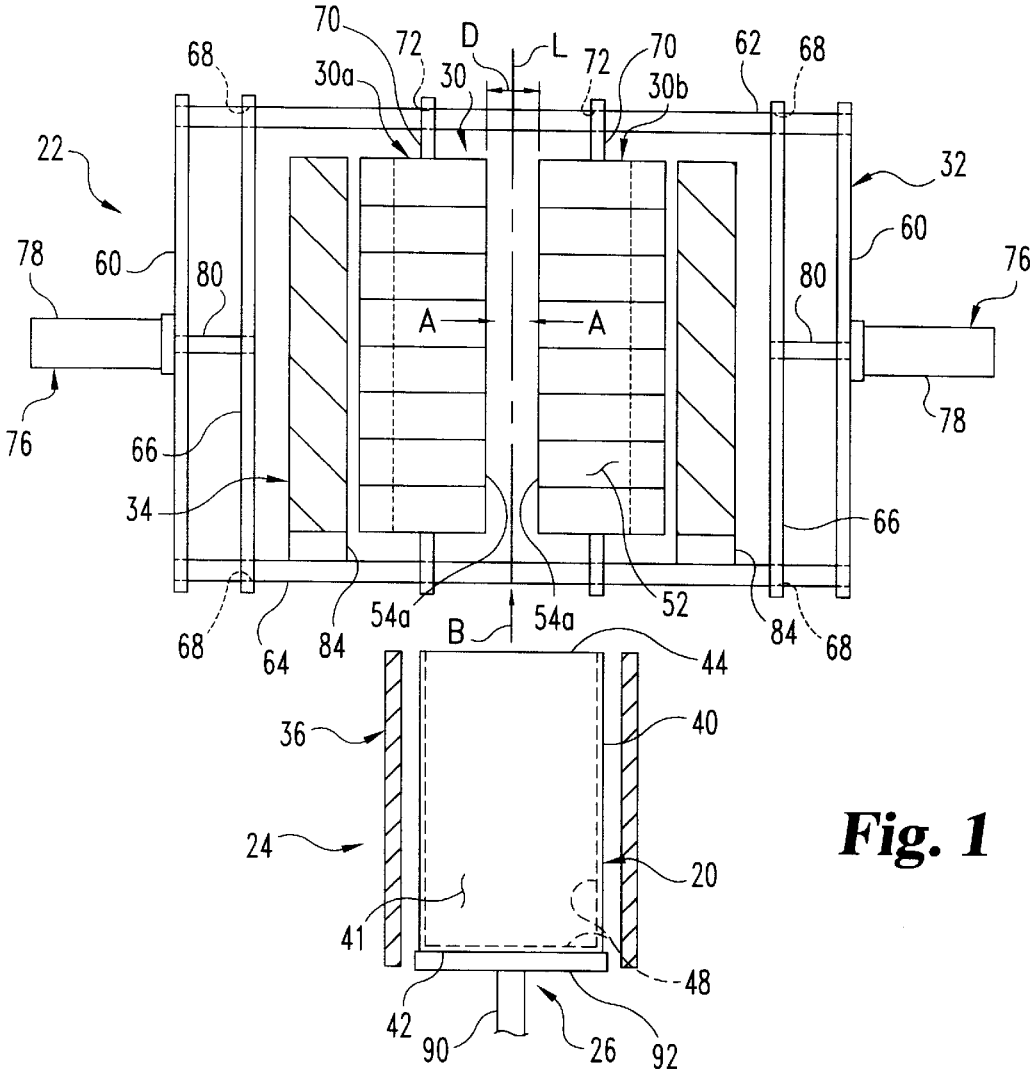
FIG. 1 is a side elevational view, in partial section, of an apparatus according to one embodiment of the present invention for use in producing an "on-demand" semi-solid use in a material.

For the purposes of promoting an understanding of the principals of the invention, reference will now be made to the embodiment illustrated in the drawings and specific language will be used to describe the same. It will nevertheless be understood that no limitation of the scope of the invention is hereby intended, and any alterations and further modifications of the illustrated device, and any further applications of the principals of the invention as illustrated herein being contemplated as would normally occur to one skilled in the art to which the invention relates.

The present invention provides an apparatus for and method of producing semi-solid slurry, on demand, having a particular fraction solid and a particular solid-particular morphology. A brief description of the apparatus and method is provided below; however, further details are disclosed in the co-pending patent application Ser. No. 09/585,061, filed on Jun. 1, 2000, by inventor Norville, Lombard, Lu, and Wang. This co-pending patent application is hereby expressly incorporated by reference for its entire disclosure.

Figure 2:
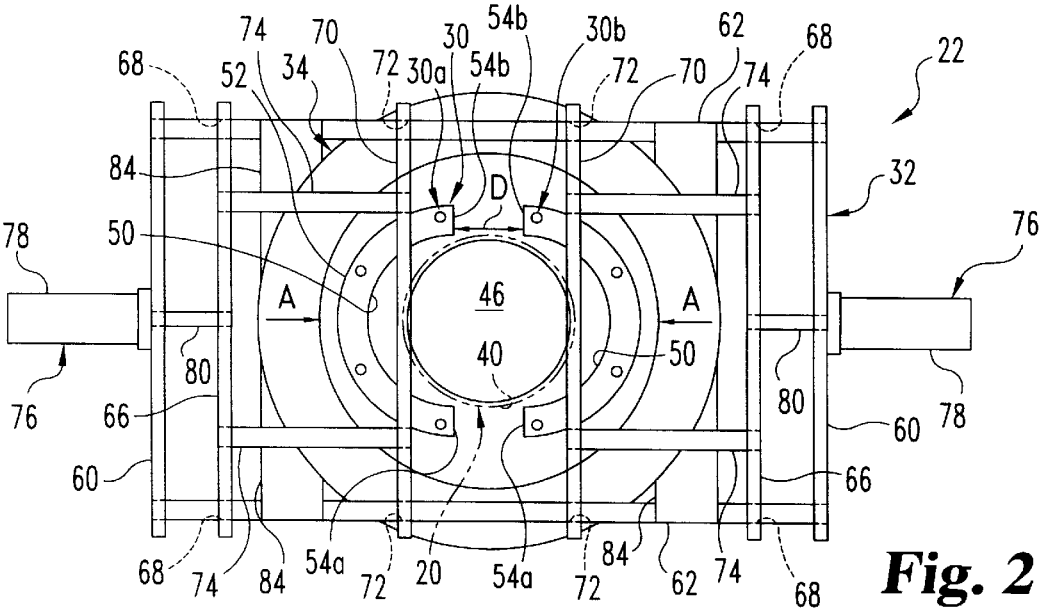
FIG. 2 is a top plan view of the apparatus depicted in FIG. 1.

With reference to FIGS. 1 and 2, there is illustrated an apparatus for producing a semi-solid slurry billet of a metal or metal alloy for subsequent use in various casting or forging applications. The apparatus generally comprises a vessel or crucible 20 for containing the molten metal, a forming station 22, a discharge station 24, and a transport mechanism 26 for transporting the vessel 20 between the forming and discharge stations 22, 24. The forming station 22 generally includes a thermal jacket 30 for controlling the temperature and cooling rate of the metal or alloy contained within vessel 20, a framework 32 for supporting and engaging thermal jacket 30 about vessel 20, and an electromagnetic stator 34 for electromagnetically stirring the metal contained within vessel 20. The discharge station 24 generally includes an induction coil 36 for facilitating the removal of the slurry billet from vessel 20 by breaking the surface bond therebetween, and means for discharging the slurry billet from vessel 20 (not shown) for subsequent transport directly to the shot sleeve of a casting or forging press.

The vessel 20 is preferably made of a non-magnetic material having low thermal resistance, good electromagnetic penetration capabilities, good corrosion resistance, and relatively high strength at high temperatures. Because vessel 20 must absorb heat from the metal contained therein and dissipate it quickly to the surrounding environment, low thermal resistance is an important factor in the selection of a suitable vessel material. Additionally, material density and thickness must also be given consideration. By way of example, vessel 20 may be made of materials including, but not limited to, graphite, ceramics, and stainless steel. To provide additional resistance to attack by reactive alloys, such as molten aluminum, and to aid in discharging the slurry billet after the forming process is completed, the inside surface of vessel 20 is preferably coated or thermally sprayed with boron nitride, a ceramic coating, or any other suitable material.

The vessel 20 preferably has a can shape, including a sidewall 40 defining a cylindrical exterior surface 41, a flat bottom wall 42, and an open top 44. Sidewall 40 and bottom wall 42 cooperate to define a hollow interior 46 bounded by interior surfaces 48. In one embodiment, vessel 20 has an outer diameter in a range of about two inches to eight inches, an overall height in a range of about nine inches to about eighteen inches, and a wall thickness in a range of about 0.05 inches to about 2 inches. However, it should be understood that other shapes and sizes of vessel 20 are also contemplated. For example, vessel 20 could alternatively define shapes such as a square, polygon, ellipse, or any other shape as would occur to one of ordinary skill in the art. Additionally, the size of vessel 20 could be changed to vary the ratio between volume and exposed interior/exterior surface area. For example, doubling the diameter of vessel 20 would correspondingly double the exposed surface area of sidewall 40, but would quadruple the volume of interior 46. Factors which may affect the selection of a suitable ratio include the desired volumetric capacity and cooling capability of vessel 20.

Although vessel 20 has been illustrated and described as having a substantially rigid, one-piece configuration, it should be understood that other configurations are also contemplated. For example, vessel 20 could be split lengthwise into two separate halves, with the halves being pivotally connected by a hinge to define a clam-shell type configuration. Additionally, vessel 20 could include heating and/or cooling elements to aid in controlling the temperature and cooling rate of the metal or alloy contained within vessel 20, particularly during the solidification process. More specifically, the vessel walls could be configured with internal heating/cooling lines to control the temperature and cooling rate of the vessel. Heat sinks or fins could also be provided on sidewall 40 to facilitate a higher conductive and/or convective heat transfer rate between vessel 20 and the surrounding environment. Other alternative configurations and additional design details regarding the type of vessel which is suitable for use as part of the present invention are disclosed in the co-pending patent application Ser. No. 09/585,296, filed on Jun. 1, 2000, by inventors Norville, Lombard, and Wang. This co-pending patent application is hereby expressly incorporated by reference for its entire disclosure.

Thermal jacket 30 is preferably made of a non-magnetic material having high thermal conductivity, good electromagnetic penetration capabilities, and relatively high strength. Because the primary purpose of thermal jacket 30 is to facilitate heat transfer between vessel 20 and a heating and/or cooling media, thermal conductivity is a particularly important factor in the selection of a suitable thermal jacket material. Additionally, because the heating/cooling capability of thermal jacket 30 is influenced by material density, specific heat and thickness, consideration must be given to these factors as well. More specifically, the amount of energy to be added/extracted ($\Delta E$) by thermal jacket 30 from the metal contained within vessel 20 is dictated by the following equation: $\Delta E=(\rho)(C_p)(V)(\Delta T)$, where $\rho$ is material density, $C_p$ is material specific heat, V is material volume, and $\Delta T$ is temperature change of the material per cycle. Further, the material of thermal jacket 30 should preferably have a coefficient of thermal expansion which is near that of vessel 20, the importance of which will become apparent below. Moreover, the material should preferably be easily machinable, the importance of which will also become apparent below. By way of example, thermal jacket 30 may be made of materials including, but not limited to, bronze, copper or aluminum.

Thermal jacket 30 extends along a longitudinal axis L and includes two generally symmetrical longitudinal halves 30*a,* 30*b*. Each half 30*a,* 30*b* has a substantially semi-cylindrical shape, defining a rounded inner surface 50, a rounded outer surface 52, and a pair of generally flat longitudinal edges 54*a,* 54*b*. The inner surface 50 is substantially complementary to the exterior surface 41 of vessel 20. In one embodiment, each half 30*a,* 30*b* of thermal jacket 30 has an inner radius approximately equal to or slightly greater than the outer radius of vessel 20, an overall height approximately equal to or greater than the height of vessel 20, and a wall thickness of about 1 inch. However, it should be understood that other shapes and sizes of thermal jacket 30 are also contemplated as would occur to one of ordinary skill in the art, including shapes and sizes complementary to those listed above with regard to vessel 20. Additionally, although thermal jacket 30 has been illustrated and described as having separate longitudinal portions 30*a,* 30*b,* it should be understood that other configurations are also possible. For example, thermal jacket 30 could alternatively take on a solid cylindrical configuration, or halves 30*a,* 30*b* could be hinged together to define a clam-shell type configuration. Further, thermal jacket 30 could alternatively include non-symmetrical longitudinal portions.

As will be discussed in greater detail below, thermal jacket 30 is provided with means for controlling the rate of heat transfer from vessel 20 to the surrounding environment through the addition/removal of heat to/from vessel 20. In one embodiment, thermal jacket 30 has the capacity to control the cooling rate of the metal contained in vessel 20 within a range of about 0.10 Celsius to about 10° Celsius per second. However, it should be understood that other cooling rates may also be utilized depending on the particular composition of metal being formed and the desired result to be obtained.

Framework 32 is provided to support thermal jacket 30 and stator 34, and to laterally displace thermal jacket halves 30*a,* 30*b* relative to longitudinal axis L. Framework 32 includes a pair of stationary base plates 60, interconnected by a pair of upper transverse guide rods 62 and a pair of lower transverse guide rods 64 to form a substantially rigid base structure. Upper and lower guide rods 62, 64 are each aligned substantially parallel to one another and oriented substantially perpendicular to longitudinal axis L. Although upper and lower guide rods 62, 64 have been illustrated and described as having a circular cross section, it should be understood that other cross sectional shapes are also contemplated, such as, for example, a square or rectangular cross section.

Framework 32 additionally includes a pair of movable actuator plates 66, each defining four openings 68 sized to receive respective ones of the upper and lower guide rods 62, 64 therethrough to allow actuator plates 66 to slide along upper and lower guide rods 62, 64 in a direction normal to longitudinal axis L. A movable connector plate 70 is rigidly attached to an upper surface of each thermal jacket half 30*a,* 30*b,* defining a pair of openings 72 sized to receive respective ones of the upper guide rods 62 therethrough to allow connector plate 70 to slide along upper guide rods 62 in a direction substantially normal to longitudinal axis L. Each connector plate 70 is interconnected to a corresponding actuator plate 66 by a pair of push rods 74 (FIG. 2). Alternatively, each connector plate 70 may be interconnected to a corresponding actuator plate 66 by a pair of plates or any other suitable connecting structure. A pair of pneumatic cylinders 76 are provided, each having a base portion 78 attached to base plate 60 and a rod portion 80 extending through base plate 60 and connected to actuator plate 66. By extending pneumatic cylinders 76, the thermal jacket halves 30*a,* 30*b* are displaced toward one another in the direction of arrows A. By retracting pneumatic cylinders 76, the thermal jacket halves 30*a,* 30*b* are displaced away from another in a direction opposite arrows A.

Although framework 32 and pneumatic cylinders 76 have been illustrated and described as providing means for selectively engaging/disengaging the thermal jacket halves 30*a,* 30*b* against the exterior surface 41 of vessel 20, it should be understood that alternative means are also contemplated, such as by way of a robotic arm or a similar actuating device. It should also be understood that the thermal jacket 30 could alternatively be securely attached directly to the exterior surface 41 of vessel 20, such as by a welding or fastening, thereby eliminating the need for framework 32 and pneumatic cylinders 76.

Electromagnetic stator 34 has a cylindrical shape and is positioned along longitudinal axis L, generally concentric with vessel 20. Stator 34 is preferably supported by framework 32, resting on a pair of cross members 84 extending between lower guide rods 64. The inner diameter of stator 34 is sized such that when the thermal jacket halves 30*a,* 30*b* are in their fully retracted positions, outer surfaces 52 will not contact the inner surfaces of stator 34. Stator 34 is preferably a multiple pole, multiple phase stator and can be of a rotary type, a linear type, or a combination of both. The magnetic field created by stator 34 preferably moves about vessel 20 in directions either substantially normal or substantially parallel to longitudinal axis L, or a combination of both. It is noted that even in applications using only a rotary type stator, where the magnetic field moves in a directions substantially normal to the longitudinal axis L, in addition to rotational movement of the metallic melt contained within vessel 20, longitudinal movement of the metallic melt is also possible.

The operation of stator 34 imparts a vigorous stirring action to the metallic melt contained within vessel 20 without actually coming into direct contact therewith. Additional design details regarding the types of stators which are suitable for the present invention, the arrangement of these stators, whether rotary, linear, or both, and the flow movement patterns corresponding to each stator arrangement are disclosed in the co-pending patent application Ser. No. 09/585,060, filed on Jun. 1, 2000, by inventors Lu, Wang, and Norville. This co-pending patent application is hereby expressly incorporated by reference for its entire disclosure.

In summary, the apparatus described above operates in the following manner. Initially, the thermal jacket halves 30*a,* 30*b* are placed in their fully retracted position by retracting pneumatic cylinders 76. Vessel 20, which at this point is empty, is raised in the direction of arrow B along longitudinal axis L from discharge station 24 to forming station 22 by way of the transport mechanism 26. In one embodiment, transport mechanism 26 includes a pneumatic cylinder (not shown) having a rod portion 90 connected to a flat circular platform 92. However, it should be understood that other means for transporting vessel 20 are also contemplated as would occur to those of ordinary skill in the art, such as, for example, a robotic arm or a similar actuating device. Vessel 20 rests on platform 92 and is preferably securely attached thereto by any means know to those of skill in the art, such as, for example, by fastening or welding. Once vessel 20 is positioned between the thermal jacket halves 30*a,* 30*b* (as shown in phantom in FIG. 2), the pneumatic cylinders 76 are extended, thereby engaging the inner surfaces 50 of the thermal jacket halves 30*a,* 30*b* into intimate contact with the exterior surface 41 of vessel 20.

Liquid metal, also referred to as a metallic melt, is then introduced into vessel 20 through upper opening 44. The liquid metal is prepared with the proper composition and heated in a furnace to a temperature higher than its liquidus temperature (the temperature at which a completely molten alloy first begins to solidify). Preferably, the liquid metal is heated to a temperature at least 5° Celsius above the liquidus temperature, and is more preferably heated to a temperature within a range of about 15° Celsius to about 70° Celsius above the liquidus temperature to avoid or at least reduce the possibility of premature solidification or skinning of the liquid metal. In one embodiment, the liquid metal is transferred to vessel 20 by a ladle (not shown); however, other suitable means are also contemplated, such as by conduit.

To avoid formation of a solidified skin, possibly resulting from contact of the liquid metal with the cool interior surfaces of vessel 20, the vessel walls 40, 42 are preferably pre-heated prior to the introduction of liquid metal. Such warming may be effected by way of thermal jacket 30 (as will be discussed below), by heating elements internal to vessel 20 (as discussed above), through the heating of vessel 20 during prior cycling of the system, or by any other suitable means occurring to those of skill in the art, such as by forced air heating. Preferably, when the alloy is A1357 or a similar composition, vessel 20 should be at a temperature of at least 200–500° Celsius prior to the introduction of liquid metal to avoid skinning or premature solidification.

Following the introduction of the molten melt into vessel 20, a cap or lid (not shown) is preferably lowered onto the open top of vessel 20 to prevent molten metal from escaping during the electromagnetic stirring process. The cap may be made from ceramic, stainless steel or any other suitable material. An electromagnetic field is then introduced by stator 34 to impart vigorous stirring action to the metallic melt. Preferably, the stirring operation commences immediately after the cap is positioned atop vessel 20. The metal is then cooled at a controlled rate and temperature throughout the stirring process by way of thermal jacket 30, the operation of which will be discussed in greater detail below. The removal of heat by thermal jacket 30 causes the liquid metal to begin to solidify, thereby forming a semi-solid slurry material.

Thermal jacket 30 provides continuous control over the temperature and cooling rate of the semi-solid slurry throughout the stirring process in order to achieve the desired slurry temperature as quickly as possible, within reason, and taking into consideration metallurgical realities, in order to achieve a comparatively short cycle time. While the primary purpose of the electromagnetic stirring is to effect nucleation and growth of the primary phase with degenerated dendritic structure, with the fraction solid, primary particle size and shape, and the delivery temperature being dictated by holding time and temperature, another purpose of the stirring process is to enhance the convective heat transfer rate between the liquid metal and the interior surfaces 48 of vessel 20. A further purpose of the stirring process is to reduce temperature gradients within the metal, thereby providing increased control over the metal temperature and the cooling rate. Still another purpose of the stirring process is to avoid, or at least minimize, the possibility of the metal in direct contact with the interior surfaces 48 of vessel 20 from forming a skin.

Upon completion of the electromagnetic stirring step, the thermal jacket halves 30*a,* 30*b* are once again placed in their fully retracted position by retracting pneumatic cylinders 76. Vessel 20, which now contains a metallic melt in the form of a slurry billet, is lowered in a direction opposite arrow B along longitudinal axis L until positioned within the induction coil 36 (FIG. 1). The induction coil 36 is then activated to generate a magnetic field which melts the outer skin of the slurry billet, breaking the surface bond existing between the interior surface of vessel 20 and the billet. Additionally, the magnetic field generated by the induction coil 36 exerts a radial compressive force onto the slurry billet to further facilitate its removal from vessel 20. In one embodiment, AC current is discharged through the induction coil 36 surrounding the vessel 20 to generate the magnetic field; however, strong magnetic forces can also be generated by discharging a high-voltage DC current through induction coil 36 disposed adjacent the bottom wall 42 of vessel 20.

After the surface bond between the slurry billet and the vessel 20 is broken, the billet is then discharged from vessel 20 and transferred directly to the shot sleeve of a casting or forging press where it is formed into its final shape or configuration. One method of discharging the slurry billet is to tilt vessel 20, along with induction coil 36, at an appropriate angle below horizontal to allow the billet to slide from vessel 20 by gravity. Such tilting action can be accomplished by a tilt table arrangement, a robotic arm, or any other means for tilting as would be apparent to those of skill in the art. Additionally, if the centers of induction coil 36 and vessel 20 are axially offset, activation of induction coil 36 will exert an axial pushing force onto the billet to further facilitate its discharge. Additional details regarding a type of induction coil which is suitable for use as part of the present invention, as well as alternative slurry billet discharge methods and apparata, are disclosed in the co-pending patent application, Ser. No. 09/585,296, filed on Jun. 1, 2000, by inventors Norville, Lombard, and Wang. This co-pending patent application has been expressly incorporated by reference for its entire disclosure.

Figure 3:
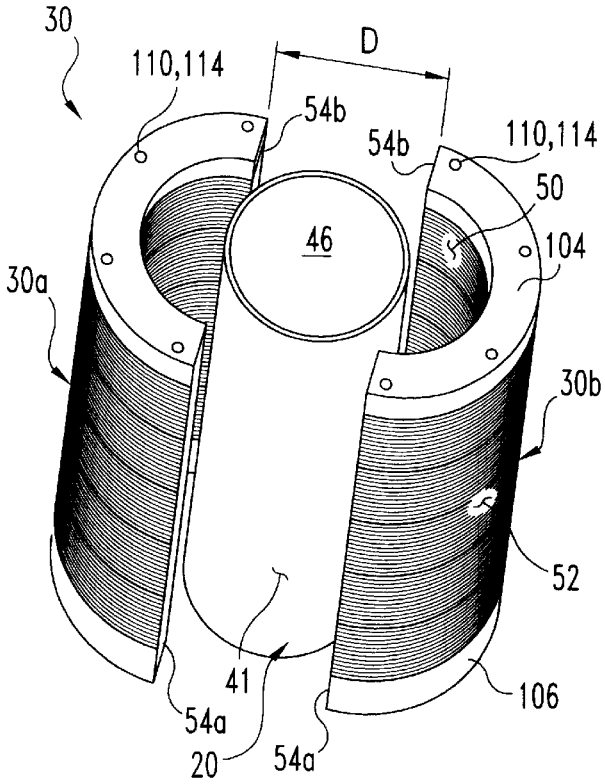
FIG. 3 is a perspective view of a thermal jacket according to one embodiment of the present invention, showing the thermal jacket in a disengaged position relative to a forming vessel.
Figure 4:
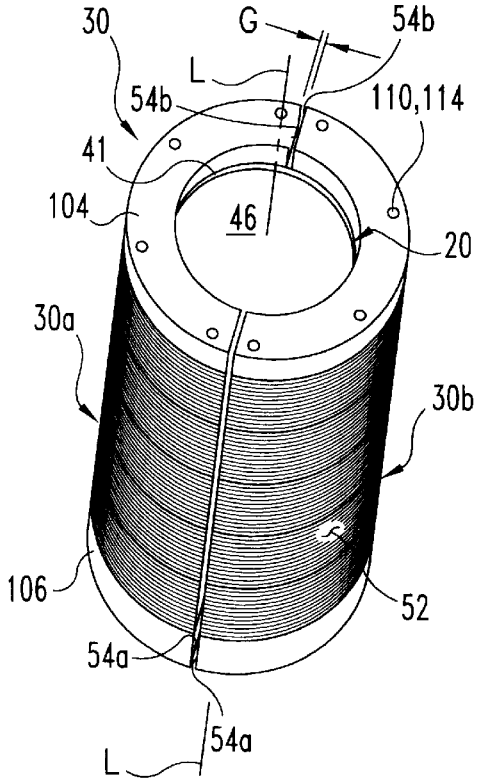
FIG. 4 is a perspective view of the FIG. 3 thermal jacket, showing the thermal jacket in an engaged position relative to the forming vessel.

Referring now to FIGS. 3–14, shown therein are various structural features regarding thermal jacket 30. As illustrated in FIG. 3, the halves 30*a*, 30*b* of thermal jacket 30 are capable of being spread apart a sufficient distance D to allow vessel 20 to be inserted therebetween while avoiding frictional interferences between the exterior surface 41 of vessel 20 and the inner surfaces 50. However, as illustrated in FIG. 4, once vessel 20 is disposed in the appropriate position along longitudinal axis L, the halves 30*a*, 30*b* are drawn together to place inner surfaces 50 into intimate contact with the exterior surface 41 of vessel 20 to effectuate conductive heat transfer therebetween. Notably, when the halves 30*a*, 30*b* are engaged against vessel 20, a gap G remains between the opposing longitudinal edges 54*a* and the opposing longitudinal edges 54*b*.

One function of gap G is to eliminate or at least reduce the distance between the exterior surface 41 of vessel 20 and the inner surfaces 50 of thermal jacket 30, especially in cases where the rates of thermal expansion/contraction vary significantly between vessel 20 and thermal jacket 30. In one embodiment, the gap G corresponds to the following function: $f_n=(\alpha_j*\pi*r_j*\Delta T_j)-(\alpha_v*\ \pi*r_v*\Delta T_v)$, where $\alpha a_j$ is the thermal expansion coefficient of the thermal jacket halves 30*a*, 30*b*, $r_j$ is the radius of the inner surfaces 50 of halves 30*a*, 30*b*, $\Delta T_j$ is the maximum temperature change of the thermal jacket halves 30*a*, 30*b*, $\alpha_v$ is the thermal expansion coefficient of the vessel 20, $r_v$ is the radius of the exterior surface 41 of vessel 20, and $\Delta T_v$ is the maximum temperature change of the vessel 20. In a preferred embodiment, the gap G is at least as large as $f_n$. However, it should be understood that gap G may take on other sizes, including any size necessary to accommodate for differing rates of thermal expansion and contraction between vessel 20 and thermal jacket 30.

Figure 5:
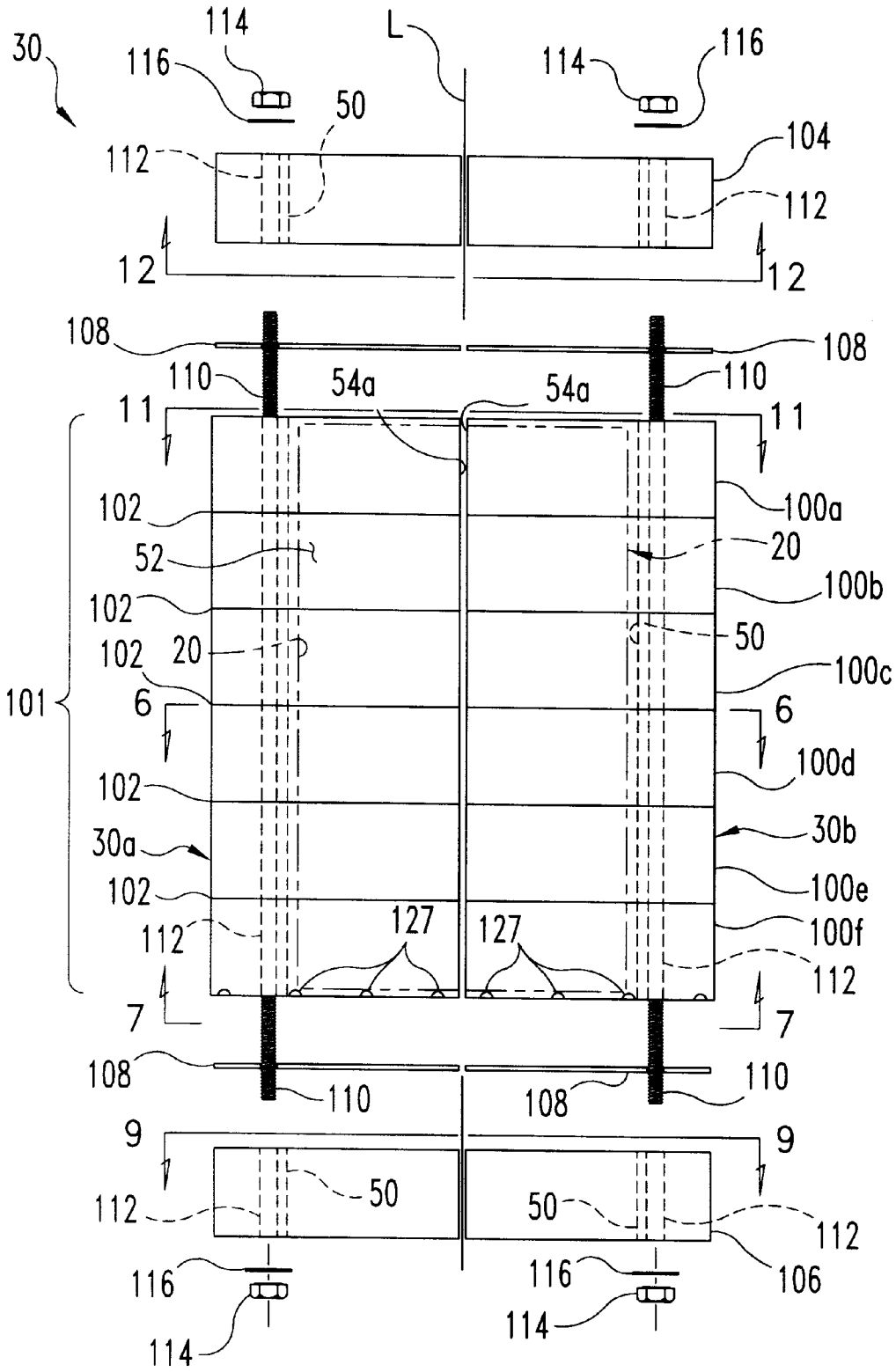
FIG. 5 is a partially exploded side elevational view of the FIG. 3 thermal jacket.

As shown in FIG. 5, in one embodiment of the present invention, thermal jacket 30 is made up of a number of individual axial sections 100*a*–100*f*, arranged in a stack along longitudinal axis L to define a main body portion 101. The separation of thermal jacket 30 into individual axial sections 100*a*–100*f* aids in reducing eddy currents which might otherwise develop in thermal jacket 30 were formed of a single axial piece, and also allows for better electromagnetic penetration of the magnetic field generated by stator 34. Although the illustrated embodiment shows main body portion 101 as being comprised of six axial sections, it should be understood that any number of axial sections may be used to provide thermal jacket 30 with varying heights. In one embodiment, each of the axial sections 100*a*–100*f* has a height of about 2 inches, providing main body portion 101 with an overall height of about 12 inches. It should also be understood that axial sections 100*a*–100*f* may alternatively be integrated to form a unitary, single piece main body portion 101.

Figure 6:
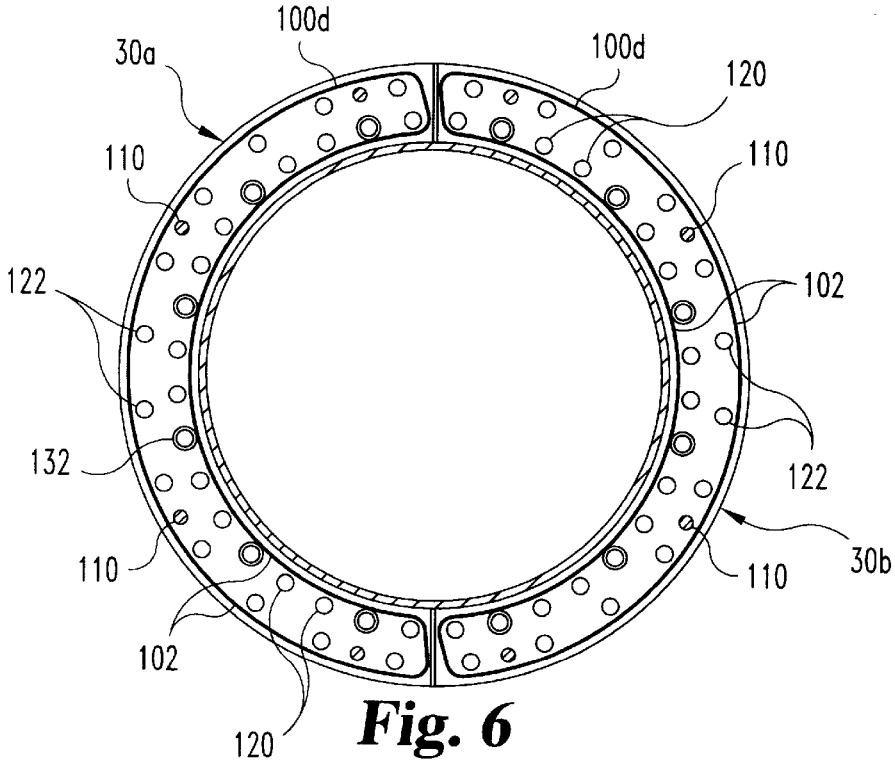
FIG. 6 is a cross sectional view of the FIG. 3 thermal jacket, as viewed along line 6—6 of FIG. 5.

As shown in FIGS. 5 and 6, each of the axial sections 100*a*–100*f* are preferably separated from one another by an electrically insulating material 102 to substantially eliminate, or at least minimize, magnetic induction losses through thermal jacket 30 during the operation of stator 34. In the illustrated embodiment, the insulating material 102 is in the form of a gasket and is made of any material having suitable insulating characteristics and capable of withstanding a high temperature environment. Such materials may include, for example, asbestos, ceramic fiber paper, mica, fluorocarbons, phenolics, or certain plastics including polyvinylchlorides and polycarbonates. Alternatively, the electrically insulating material 102 may comprise a coating of a conventional varnish or a refractory oxide layer applied to the abutting surfaces of axial sections 100*a*–100*f*. In either embodiment, the thickness of electrically insulating material 102 is preferably as thin as possible so as to avoid a significant decrease in the conductivity of thermal jacket 30. Preferably, the thickness of electrically insulating material 102 is in a range of about 0.063 inches to about 0.125 inches.

Thermal jacket 30 preferably includes an upper air manifold 104 and a lower air manifold 106, the purposes of which will be discussed below. A gasket material 108 is disposed between upper manifold 104 and axial section 100*a*, and between lower manifold 106 and axial section 100f, to provide a seal between the abutting surfaces, the importance of which will become apparent below. Gasket material 108 is made of any suitable material, such as, for example, asbestos, mica, fluorocarbons, phenolics, or certain plastics including polyvinylchlorides and polycarbonates. Gasket material 108 is arranged in a manner similar to insulating material 102 (FIG. 6) to form a continuous seal adjacent the peripheral edges of each half of upper and lower manifolds 104, 106. Preferably, the thickness of gasket material 108 is within a range of about 0.063 inches to about 0.125 inches.

Axial sections 100*a*–100*f*, upper manifold 104, and lower manifold 106 are joined together to form integrated thermal jacket halves 30*a*, 30*b*. In the illustrated embodiment, four threaded rods 110 are passed through corresponding openings 112 extending longitudinally along the entire length of each half 30*a*, 30*b*. However, it should be understood that any number of threaded rods could be used to join the axial sections 100*a*–100*f*. A nut 114 and washer 116 are disposed at each end of rod 110, with nut 114 being tightly threaded onto rod 110 to form substantially rigid thermal jacket halves 30*a*, 30*b*. Other suitable means for joining the axial sections and manifolds are also contemplated, such as, for example, by tack welding.

Figure 7:
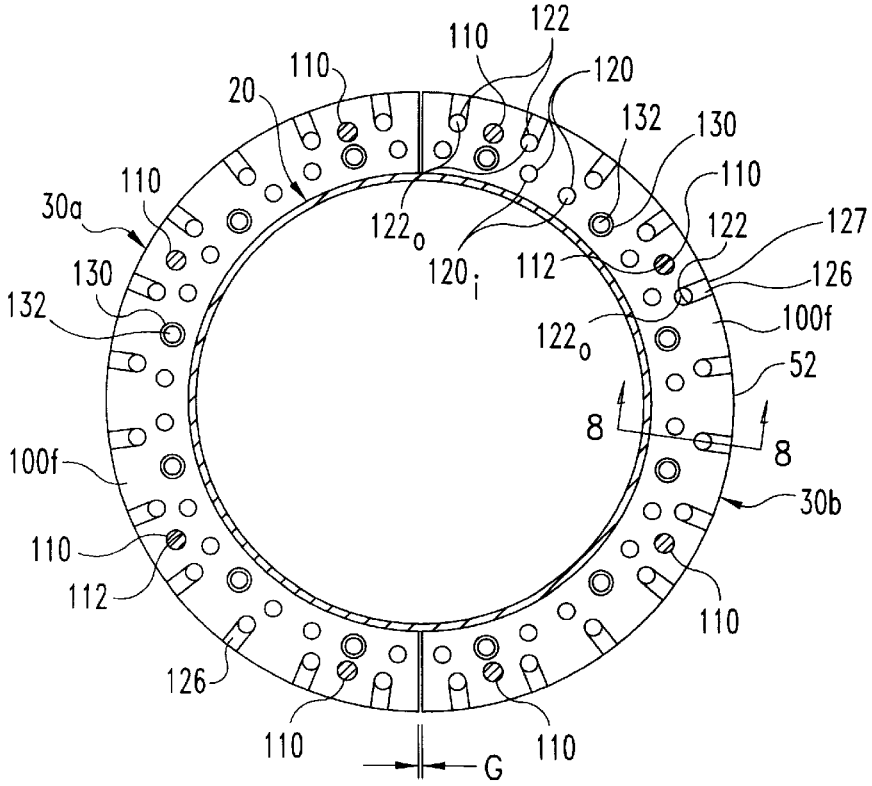
FIG. 7 is a bottom plan view of the main body of the FIG. 3 thermal jacket, as viewed along line 7—7 of FIG. 5.
Figure 8:
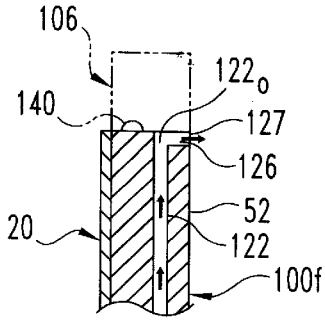
FIG. 8 is a partial cross sectional view of the FIG. 3 thermal jacket, as viewed along line 8—8 of FIG. 7.

Referring now to FIGS. 7–8, shown therein are various details regarding the lowermost axial section 100*f*. With regard to the following description of axial section 100*f*, except where noted, the features of axial section 100*f* apply equally as well to axial sections 100*a*–100*e*. Axial sections 100*a*–100*f* each include a plurality of inner axially extending passageways 120, and a corresponding plurality of outer axially extending passageways 120. Inner and outer passageways 120, 122 are disposed generally along longitudinal axis L and are dispersed circumferentially about thermal jacket halves 30*a*, 30*b*. The axial passageways 120, 122 of each axial section 100*a*–100*f* are correspondingly aligned to form substantially continuous axially extending passageways 120, 122, preferably running the entire length of main body portion 101. In the illustrated embodiment, there are twenty-four inner passageways 120 and twenty-four outer passageways 122; however, other quantities are also contemplated as being within the scope of the invention. The inner and outer passageways 120, 122 serve to transport a cooling media along the length of thermal jacket 30 to effectuate convective heat transfer between the cooling media and thermal jacket 30 and, as a result, extract heat from vessel 20 and the metal alloy contained therein. In a preferred embodiment, the cooling media is compressed air; however, other types of cooling media are also contemplated, such as, for example, other types of gases, or fluids such as water or oil.

The inner axial passageways 120 transport the cooling air from inlet openings 120*i*, defined by the lowermost axial section 100*f*, to outlet openings 120*o* (FIGS. 11 and 14), defined by the uppermost axial section 100*a*. Preferably, inner passageways 120 are semiuniformly offset about the circumference of thermal jacket halves 30*a*, 30*b* to provide a relatively even extraction of heat from vessel 20. Additionally, inner passageways 120 are preferably radially positioned, in a uniform manner, adjacent inner surface 50 of thermal jacket 30 to minimize lag time between adjustments in cooling air flow rate and corresponding changes in the rate of heat extraction from vessel 20 and the metal alloy contained therein. However, other spacing arrangements and locations of inner passageways 120 are also contemplated as being within the scope of the invention. In one embodiment, the inner passageways 120 have a diameter of about 0.250 inches. However, other passageway sizes are also contemplated as being within the scope of the invention, with passageway size being determined by various design considerations, such as, for example, the desired cooling air flow rate, the heat transfer rate, and change in air temperature between the cooling air passageway inlets 120*i* and outlets 120*o*.

Figure 14:
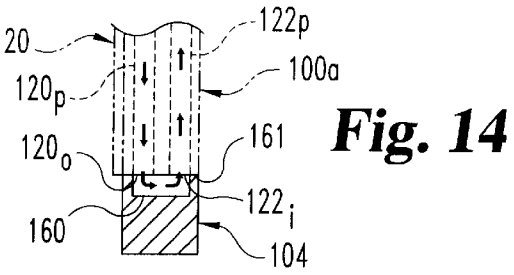
FIG. 14 is a partial cross sectional view of the FIG. 12 upper manifold, as viewed along line 14—14 of FIG. 12.
Figure 11:
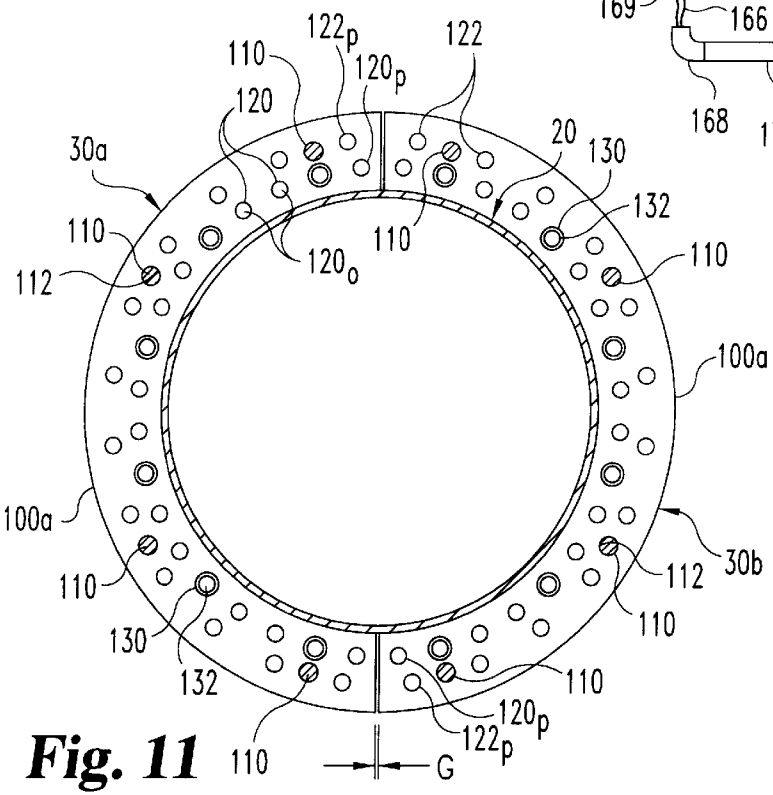
FIG. 11 is a top plan view of the main body of the FIG. 3 thermal jacket, as viewed along line 11—11 of FIG. 5.

As will be discussed in greater detail below, the cooling air exiting outlet openings 120*o* is redirected, by way of upper manifold 104, and fed into inlet openings 122*i* of outer axial passageways 122 (FIGS. 11 and 14). The outer passageways 122 transport the cooling air from inlet openings 122*i*, defined by the uppermost axial section 100*a*, to outlet openings 122*o*, defined by the lowermost axial section 100*f* (FIG. 7). Preferably, outer passageways 122 are uniformly offset about the circumference of thermal jacket halves 30*a*, 30*b* to provide a relatively even extraction of heat from vessel 20. Additionally, outer passageways 122 are preferably uniformly positioned radially outward of inner passageways 120. However, other spacing arrangements and locations of outer passageways 122 are also contemplated as being within the scope of the invention. For example, the outer passageways 122 could be disposed along the same radius as inner passageways 120 to reduce the thickness of thermal jacket halves 30*a*, 30*b*. In one embodiment, outer passageways 122 have a diameter of about 0.250 inches; however, other sizes are also contemplated as being within the scope of the invention.

The cooling air exiting outlet openings 122*o* is fed into a number of transverse notches 126, which are only defined in the lowermost axial section 100*f*, to exhaust the heat ladened cooling air to atmosphere. Transverse notches 126 extend between outer axial passageways 122 and the outer surface 52 of thermal jacket 30 in a direction substantially normal to longitudinal axis L, and cooperate with the lower manifold 106 to define exhaust ports 127 (additionally shown in FIG. 5). Thus, instead of exhausting the cooling air in a downward direction, where it may cause dust or debris to become airborne and possibly contaminate the system, the cooling air is directed in a lateral direction to avoid or at least minimize the potential for contamination.

Although the cooling air system has been illustrated and described as an open system, where the cooling air is ultimately discharged to atmosphere, it should be understood that a closed system could alternatively be used in which the cooling air is continually recirculated through thermal jacket 30. Such a closed system could include means for removing heat from the system, such as, for example, by a chiller, heat exchanger, or another type of refrigeration device. Additionally, although thermal jacket 30 has been illustrated and described as utilizing a two-pass cooling air route, it should be understood that thermal jacket 30 could alternatively be designed with a single-pass cooling air route to correspondingly reduce the thickness of thermal jacket halves 30*a*, 30*b*. It should also be understood that thermal jacket 30 could alternatively be designed with a multiple pass cooling air route, or with a continuous cooling air route extending spirally about a single piece thermal jacket 30.

Notably, inner passageways 120 are preferably disposed radially inward of outer passageways 122, adjacent the inner surface 50 of thermal jacket halves 30*a*, 30*b*, to maximize the heat transfer efficiency of thermal jacket 30. More specifically, the cooling air flowing through inner passageways 120 is at a lower temperature than the cooling air flowing through outer passageways 122. To maximize heat transfer efficiency, the inner passageways 120, which contain cooler air, are positioned closest to the location of highest temperature, namely at a location adjacent vessel 20. On the other hand, the outer passageways 122, which contain air that has been warmed through convective heat transfer, are positioned at a location of lower temperature. Thus, the particular placement of the inner and outer passageways 120, 122 serves to maximize the ability of thermal jacket 30 to extract heat from vessel 20 and the metal contained therein.

In addition to using forced air cooling to extract heat from vessel 20, thermal jacket 30 also preferably includes means for adding heat to vessel 20 to provide additional control over the temperature and cooling rate of the metal alloy. Axial sections 100*a*–100*f* each include a plurality of axially extending apertures 130, disposed generally along longitudinal axis L and dispersed circumferentially about thermal jacket halves 30*a*, 30*b*. The apertures 130 of each axial section 100*a*–100*f* are correspondingly aligned to form substantially continuous axial apertures 130 running the entire length of main body portion 101. Within each aperture 130 is disposed a heating element 132. In the illustrated embodiment, there are twelve apertures 130, each having a diameter of about 0.375 inches. Preferably, apertures 130 are uniformly offset about the circumference of thermal jacket halves 30*a*, 30*b* to provide a relatively even distribution of heat. Additionally, apertures 130 are preferably positioned along the same radius as inner cooling air passageways 120, adjacent inner surface 50 of thermal jacket 30, to maximize heat transfer efficiency and to minimize lag time between activation of heating elements 132 and the addition of heat to vessel 20 and the metal alloy contained therein. It should be understood, however, that other quantities, sizes, spacing arrangements and locations of apertures 130 are also contemplated as being within the scope of the invention. It should also be understood that other means for adding heat to vessel 20 may be incorporated into thermal jacket 30, such as, for example, a series of heating air passageways configured similar to cooling air passageways 120, 122 and adapted to carry a heated fluid, such as air.

Preferably, heating element 132 is of the cartridge type, defining a generally circular outer cross section and having a length approximately equal to the height of main body portion 101. In one embodiment, heating element 132 has a diameter of about 0.375 inches, an overall length of 12 inches, a temperature range between about 30° Celsius and about 800° Celsius, a power rating of about 1000 watts, and a heating capacity of about 3,400 BTU/hr. However, it should be understood that other types, styles and sizes of heating elements are also contemplated. Some factors to consider in the selection of a suitable heating element include the specific composition of the metal alloy being produced, the desired cycle time, the heating response/lag time, etc. An example of a suitable electrical cartridge heating element is manufactured by Watlow Electric Manufacturing Company of St. Louis, Md. under Part No. G12A47; however, other suitable heating elements are also contemplated as would occur to one of ordinary skill in the art.

Figure 9:
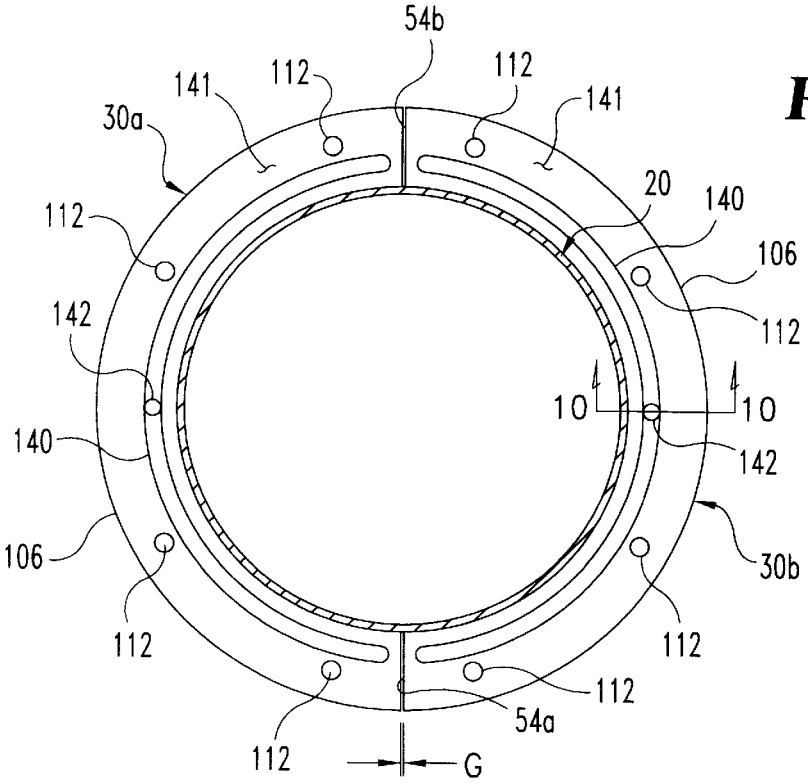
FIG. 9 is a top plan view of a lower manifold of the FIG. 3 thermal jacket, as viewed along line 9—9 of FIG. 5.
Figure 10:
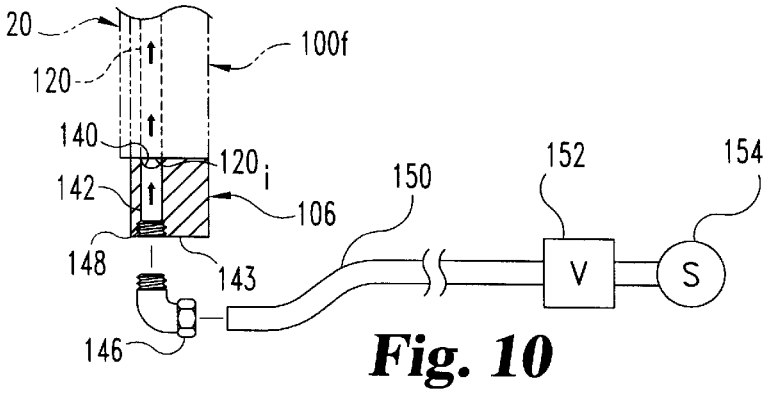
FIG. 10 is a partial cross sectional view of the FIG. 9 lower manifold, as viewed along line 10—10 of FIG. 9.

Referring now to FIGS. 9–10, shown therein are various details regarding the lower air manifold 106. In one embodiment, lower air manifold 106 has an outer profile corresponding to that of main body portion 101 and has a height of about 2 inches; however, other configurations and sizes of lower manifold 106 are also contemplated as would occur to one of ordinary skill in the art. Each half 30*a*, 30*b* of lower manifold 106 includes a circumferentially extending air distribution slot 140 defined in upper surface 141, continuously extending from a point adjacent longitudinal edge 54*a* to a point adjacent longitudinal edge 54*b*. Importantly, the slot 140 is positioned along the same radius as the inner cooling air passageways 120 and is placed in fluid communication with each of the inner passageways 120 when lower manifold 106 is attached to a respective half 30*a*, 30*b* of main body portion 101. Preferably, slot 140 has a width equal to or slightly greater than the diameter of inner passageways 120 and a depth equal to or greater than the width. In one embodiment, slot 140 has a width of about 0.250 inches and a depth of about 0.500 inches. Lower manifold 106 also defines an air inlet opening 142, extending between lower surface 143 and slot 140. Air inlet opening 142 preferably has a diameter approximately equal to the width of slot 140. An air inlet fitting 146 is threaded into an internally threaded portion 148 of inlet opening 142. An air supply conduit 150, preferably in the form of a flexible tube, is connected to air fitting 146. Thus, cooling air supplied through a single point conduit 150 is communicated to slot 140 and distributed to each of the inner cooling air passageways 120 via lower manifold 106.

A valving arrangement is provided, such as valve 152, to control the flow rate of air between a compressed air source 154 and the air supply conduit 150 leading to thermal jacket 30. Controlling the flow rate of cooling air in turn controls the rate of convective heat transfer between the thermal jacket 30 and the cooling air, which correspondingly controls the temperature and rate of heat extraction from the metal alloy contained within vessel 20. In a preferred embodiment, the valve 152 is an electrically operated metering valve capable of automatically controlling the flow rate of the cooling air. An example of a suitable electrically operated metering valve is manufactured by SMC of Indianapolis, Ind. under Part No. VY1D00-M5; however, other suitable electrical valves are also contemplated as would occur to one of ordinary skill in the art. It should be understood that valve 152 could alternatively be a manual valve, such as a hand-operated pressure regulator or any other suitable valve arrangement.

Referring now to FIGS. 11–14, shown therein are various details regarding the uppermost axial section 100*a* and upper air manifold 104. As mentioned above, the cooling air exiting outlet openings 120*o* of inner cooling air passageways 120 is redirected, by way of upper manifold 104, into inlet openings 122*i* of outer passageways 122. More specifically, a number of angled slots 160 are defined in the lower surface 161 of upper manifold 104. Importantly, each slot 160 has a length, orientation and location which positions slot 160 directly over a corresponding pair of inner and outer passageways 120*p*, 122*p* (FIG. 11) when upper manifold 104 is attached to main body portion 101. In this manner, slots 160 place corresponding pairs of passageways 120*p*, 122*p* in fluid communication with one another, thereby directing the air exiting inner passageways 120 into outer passageways 122. Preferably, slot 160 has a width approximately equal to or greater than the larger diameter of inner and outer passageways 120, 122, and a depth equal to or greater than the width. In one embodiment, slot 160 has a width of about 0.250 inches and a depth of about 0.500 inches. In an alternative embodiment, the bottom of slot 160 may be rounded to provide a smoother transition between inner and outer passageways 120, 122, thereby reducing the pressure drop across upper manifold 104. In another embodiment of upper manifold 104, the individual slots 160 may be replaced by a circumferentially extending slot continuously extending from a point adjacent longitudinal edge 54*a* to a point adjacent longitudinal edge 54*b*, and positioned in fluid communication with each of the outlet openings 120*o* and the inlet openings 122*i*.

Figure 12:
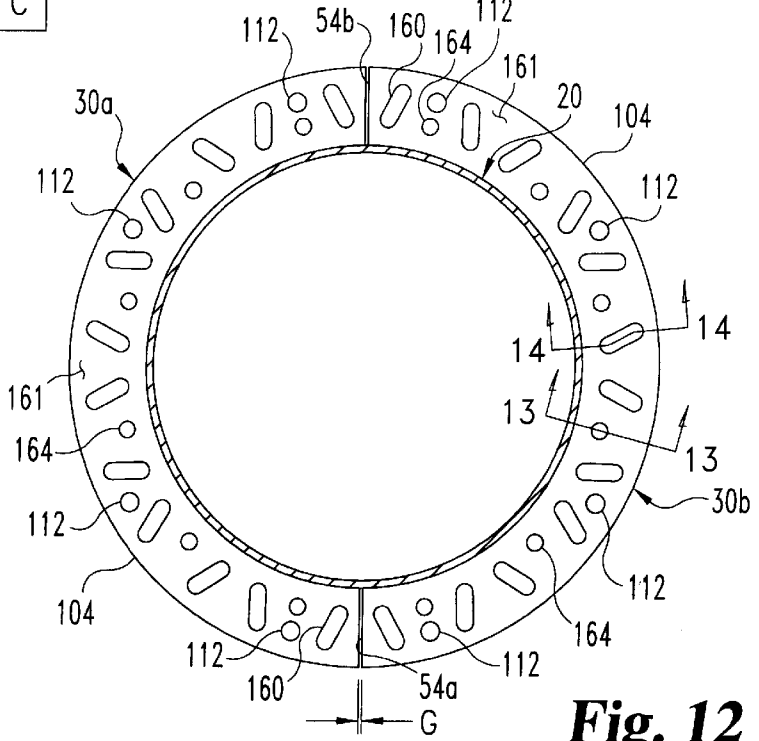
FIG. 12 is a bottom plan view of an upper manifold of the FIG. 3 thermal jacket, as viewed along line 12—12 of FIG. 5.
Figure 13:
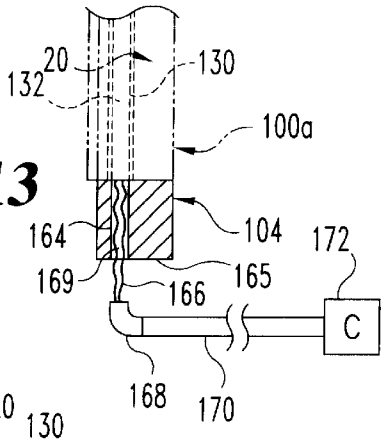
FIG. 13 is a partial cross sectional view of the FIG. 12 upper manifold, as viewed along line 13—13 of FIG. 12.

Referring to FIGS. 12–13, shown therein is one method of wiring heating elements 132; however, it should be understood that other wiring methods are also contemplated as being within the scope of the invention. Specifically, upper manifold 104 defines a number of exit apertures 164 extending therethrough between bottom surface 161 and top surface 165. Each of the exit apertures 164 are aligned with corresponding ones of the heating element apertures 130 when upper manifold 104 is attached to main body portion 101. The electrical leads 166 extending from the end of heating elements 132 are passed through exit apertures 164 to a location outside of upper manifold 104. Electrical leads 166 are routed through an air-tight electrical connector 168, which in turn is threaded into an internally threaded portion 169 of exit aperture 164. The leads 166 are then preferably routed through an electrical cable 170 and wired to a heating element controller 172. An example of a suitable heating element controller is manufactured by Watlow Electric Manufacturing Company of Winona, Minn. under Part No. DC1V-6560-F051; however, other suitable controllers are also contemplated as would occur to one of ordinary skill in the art.

Preferably, a programmable logic controller (not shown) or another similar device is employed to automatically control the cooling rate of the metallic melt contained within vessel 20, such as through closed-loop PID control, as well as control or monitor other system parameters and characteristics. For example, the programmable logic controller (or PLC) may be configured to regulate the flow rate of cooling air by controlling the operation of control valve 152, and to activate the heating elements 132 by controlling the operation of heating element controller 172. Additionally, the PLC may be used to control the extension/retraction of the pneumatic cylinders 76, 78 and/or the operation of transport mechanism 26. The PLC could also be used to monitor various temperature sensors or thermocouples adapted to provide closed-loop feedback to provide increased control over the temperature and cooling rate of the metallic melt contained within vessel 20. Additionally, the PLC could be used to control the operation of other devices used within the system, such as stator 34 or induction coil 36.

Following is a summarization of the operation of thermal jacket 30 with regard to controlling the temperature and cooling rate of the metallic melt. As discussed above, thermal jacket 30 preferably has the capacity to control the cooling rate of the metal alloy contained in vessel 20 within a range of about 0.1° Celsius to about 10° Celsius per second. The importance of maintaining such tight control over temperature and cooling rate is to regulate the solidification of the liquid metal to a semi-solid slurry to ensure the desired semi-solid forming process parameters and material properties are satisfied. Additionally, the short cycle times associated with the semi-solid forming process of the present invention require a relatively higher degree of control over temperature and cooling rate than do prior forming processes exhibiting lengthier cycle times. Further, it has been found that by controlling the initial temperature of vessel 20 prior to the introduction of the metallic melt, the cycle time associated with the semi-solid forming process can be effectively reduced.

Following the clamping of thermal jacket 30 into intimate engagement with the exterior surface 41 of vessel 20, liquid metal is introduced into vessel 20. Almost instantaneously, heat begins to shift from the liquid metal to the sidewall 40 of vessel 20 through both conductive and convective heat transfer. As the temperature of sidewall 40 rises, heat is transferred, primarily through conduction, from sidewall 40 to the thermal jacket halves 30*a*, 30*b*. Acting as a heat sink, thermal jacket halves 30*a*, 30*b* quickly and efficiently dissipate heat to the surrounding environment through convective heat transfer to the pressurized air flowing through cooling air passageways 120, 122, which in turn is discharged to atmosphere through air exhaust ports 127. Heat is also dissipated to the surrounding environment through convective heat transfer by way of air currents flowing across the exposed outer surfaces of thermal jacket 30.

By regulating the amount of air flowing through cooling air passageways 120, 122, a certain degree of control is obtained over the temperature and cooling rate of the metal alloy contained within vessel 20. For example, by increasing the flow rate of air passing through passageways 120, 122, a greater amount of heat is dissipated to the surrounding environment, which in turn correspondingly lowers the temperature of thermal jacket 30. By lowering the temperature of thermal jacket 30, the rate of heat transfer between vessel 20 and thermal jacket 30 is increased, which correspondingly increases the rate of heat extraction from the metal alloy contained within vessel 20, thereby decreasing its temperature and increasing its cooling rate. Likewise, decreasing the amount of air passing through passageways 120, 122 has the effect of correspondingly decreasing the cooling rate of the metal contained within vessel 20. In another embodiment of the invention, the inlet temperature of the cooling air introduced into thermal jacket 30 can be varied to provide additional control over the temperature and cooling rate of the metal alloy contained in vessel 20.

Since temperature and cooling rates are somewhat difficult to control through forced air cooling alone, heating elements 132 are included to provide an added degree of control. Since adjustments made to an electrical control circuit are typically more precise than adjustments made to a pneumatic control circuit, the inclusion of electrical heating elements 132 provides a greater degree of precision to the overall control scheme. More specifically, heating elements 132 are integrated into the control scheme to provide a type of feedback-controlled electric heating circuit. If the forced air cooling circuit overshoots the target temperature or target cooling rate (i.e., too low of a temperature, or too fast of a cooling rate), activation of the heating elements 132 stabilizes the system and restores the system to the desired target temperature and the desired target cooling rate. The cycle time of heating elements 132 is dependant on the heating capacity of heating elements 132, the desired amount of precision in the control circuit, the lag time inherent in the electrical and pneumatic control circuits, the target temperature and rate of cooling, and other factors which affect the transfer of heat. As discussed above, heating elements 132 can also be used to preheat vessel 20 prior to the introduction of liquid metal to avoid the formation of a solidified skin. Preferably, vessel 20 should be preheated to avoid premature solidification or skinning.

It should be understood that the heating/cooling capacity of thermal jacket 30 can be modified to accommodate other semi-solid forming processes or to produce particular compositions of metal or metal alloy. For example, the heating/cooling capacity of thermal jacket 30 can be modified by changing the number, size or location of the cooling passageways 120, 122, by increasing/decreasing the inlet temperature or flow rate of the cooling air, by adding/removing heating elements 132 or changing the heating capacity, cycle time, or location of heating elements 132, by modifying the aspect ratio of vessel 20 and/or thermal jacket 30, or by making vessel 20 and/or thermal jacket 130 out of a different material.

While the invention has been illustrated and described in detail in the drawings and foregoing description, the same is to be considered as illustrative and not restrictive in character, it being understood that the preferred embodiment has been shown and described and that all changes and modifications that come within the spirit of the invention are desired to be protected.

What is claimed is:

1. An apparatus for controlling the temperature of a metallic melt, comprising:

a vessel including an interior and an exterior, said interior containing the metallic melt; and a multi-portion thermal jacket including a first portion defining a first surface and a second portion defining a second surface, said first and second portions being displaceable relative to one another; and wherein said exterior of said vessel defines a rounded surface; and wherein said first and second surfaces are substantially complementary to said rounded surface; and wherein said first and second surfaces are each engageable in intimate contact with said exterior of said vessel to effectuate conductive heat transfer between said vessel and said thermal jacket.

2. The apparatus of claim 1 wherein said rounded surface is substantially cylindrical shaped.

3. The apparatus of claim 1 wherein said first and second portions are substantially symmetrical semi-cylindrical halves.

4. The apparatus of claim 1 wherein said first and second portions of said thermal jacket are made of a non-magnetic material.

5. The apparatus of claim 4 wherein said first and second portions of said thermal jacket are made of bronze.

6. The apparatus of claim 1 wherein said thermal jacket controls the cooling rate of the metallic melt within a range of about 0.1 degrees Celsius per second to about 10 degrees Celsius per second.

7. The apparatus of claim 1 wherein said first and second portions of said thermal jackets are securely attached to said exterior of said vessel.

8. The apparatus of claim 1 wherein said vessel includes a first longitudinal portion pivotally connected to a second longitudinal portion, said first and second portions of said thermal jacket being respectively attached to said first and second longitudinal portions of said vessel.

9. The apparatus of claim 1 further comprising means for positioning said first portion and said second portion into said intimate contact with said exterior of said vessel.

10. The apparatus of claim 1 further comprising means for transporting said vessel between a first axial position remote from said thermal jacket and a second axial position in which said vessel is disposed between said first and second portions of said thermal jacket.

11. The apparatus of claim 1 further comprising a stator disposed about said first and second portions of said thermal jacket, said stator adapted to impart an electromagnetic stirring force to said metallic melt.

12. The apparatus of claim 1, wherein said thermal jacket includes means for controlling the cooling rate of the metallic melt, said controlling means having a precision of about 0.1 degrees Celsius per second.

13. The apparatus of claim 12 wherein said controlling means controls the cooling rate of the metallic melt within a range of about 0.1 degrees Celsius per second to about 10 degrees Celsius per second.

14. The apparatus of claim 12 wherein said thermal jacket includes a plurality of passageways adapted to carry a cooling media, said cooling media flowing through said plurality of passageways to extract heat from the metallic melt.

15. The apparatus of claim 14 wherein said cooling media is air.

16. The apparatus of claim 14 wherein the thermal jacket includes a plurality of heating elements, said heating elements capable of being activated to add heat to said metallic melt.

17. The apparatus of claim 16 wherein said heating elements are electric.

18. The apparatus of claim 17 further comprising:

an electric valve for regulating the flow rate of said cooling media; and a controller electrically coupled to said electric valve to control said flow rate of said cooling media and to said plurality of electric heating elements to control activation of said electric heating elements.

19. An apparatus for controlling the temperature of a metallic melt, comprising:

a vessel including an interior and an exterior, said interior containing the metallic melt; and a multi-portion thermal jacket including a first portion defining a first surface and a second portion defining a second surface, said first and second portions being displaceable relative to one another; and wherein said first and second surfaces are each engageable in intimate contact with said exterior of said vessel to effectuate conductive heat transfer between said vessel and said thermal jacket; and wherein said first surface extends between a first pair of axial edges and said second surface extends between a second pair of axial edges, said first pair of axial edges being disposed in spaced relation relative to said second pair of axial edges of define a gap therebetween when said first and second surfaces are engaged in intimate contact with said exterior of said vessel.

20. The apparatus of claim 19 wherein said gap is sized to accommodate for relative thermal expansion and contraction between said vessel and said thermal jacket.

21. The apparatus of claim 20 wherein said gap corresponds to a function $f_n=(\alpha_j^* \pi^* r_j^* \Delta T_j)-(\alpha_v^* \pi^* \Delta T_v)$, where:

$a_j$ is a thermal expansion coefficient of said first and second portions of said thermal jacket;

$r_j$ is a radius of said first and second surfaces of said thermal jacket;

$\Delta T_j$ is a maximum temperature change of said first and second portions of said thermal jacket;

$\alpha_v$ is a thermal expansion coefficient of said vessel;

$r_v$ is a radius of said exterior of said vessel;

$\Delta T_v$ is a maximum temperature change of said vessel; and wherein said gap is at least as large as $f_n$.

22. The apparatus of claim 19 wherein said first pair of axial edges and said second pair of axial edges are each substantially flat surfaces, said substantially flat surfaces being oriented substantially parallel when said first and second surfaces are engaged in intimate contact with said exterior of said vessel.

23. An apparatus for controlling the temperature of a metallic melt, comprising:

a vessel including an interior and an exterior, said interior containing the metallic melt; and a multi-portion thermal jacket including a first portion defining a first surface and a second portion defining a second surface, said first and second portions being displaceable relative to one another; and wherein each of said first and second portions of said thermal jacket is comprised of a plurality of axial sections, said axial sections being joined together to form substantially rigid ones of said first and second portions; and wherein said first and second surfaces are each engageable in intimate contact with said exterior of said vessel to effectuate conductive heat transfer between said vessel and said thermal jacket.

24. The apparatus of claim 23 wherein an electrically insulating material is disposed between adjacent ones of said plurality of axial sections.

25. The apparatus of claim 23 wherein said axial sections of each of said first and second portions are joined together by at least one rod extending through axial openings defined through each of said axial sections.

26. An apparatus for controlling the temperature of a metallic melt, comprising:

a vessel including an interior and an exterior, said interior containing the metallic melt;

a multi-portion thermal jacket, including a first portion and a second portion; and an actuator mechanism coupled to said first and second portions of said thermal jacket, said actuator mechanism adapted to displace said first and second portions relative to said vessel and to position said first and second portions in thermal communication with said vessel to effectuate heat transfer between said vessel and said thermal jacket; and wherein said exterior of said vessel defines a substantially cylindrical outer cross section, and wherein said first and second portions define surfaces that are substantially complementary to said substantially cylindrical outer cross section.

27. The apparatus of claim 26 wherein said actuator mechanism includes:

a framework adapted to movably support said first and second portions;

a first actuator coupled to said first portion;

a second actuator coupled to said second portion; and wherein said first and second actuator are adapted to respectively displace said first and second portions in a first direction toward one another to engage said first and second portions against said exterior of said vessel, and in a second direction away from one another to disengage said first and second portions from said exterior of said vessel.

28. The apparatus of claim 27, wherein said framework includes:

a first base plate;

a second base plate;

a plurality of guide members extending between said first and second base plates;

a first actuator plate slidably supported by at least two of said guide members and being coupled to said first portion, said first actuator being coupled between said first base plate and said first actuator plate;

a second actuator plate slidably supported by at least two of said guide members and being coupled to said second portion, said second actuator being coupled between said second base plate and said second actuator plate; and wherein said first and second actuators are capable of slidably displacing said first and second actuator plates along said guide members to displace said first and second portions in said first and second directions.

29. The apparatus of claim 28 wherein said first and second actuator are pneumatic cylinders.

30. The apparatus of claim 26 further comprising means for transporting said vessel between a first axial position remote from said thermal jacket and a second axial position in which said vessel is disposed between said first and second portions of said thermal jacket.

31. An apparatus for controlling the temperature of a metallic melt, comprising:

a vessel including an interior and an exterior, said interior containing the metallic melt;

a multi-portion thermal jacket, including a first portion and a second portion; and an actuator mechanism coupled to said first and second portions of said thermal jacket, said actuator mechanism adapted to displace said first and second portions relative to said vessel and to position said first and second portions in thermal communication with said vessel to effectuate heat transfer between said vessel and said thermal jacket; and wherein said thermal jacket has an axis, said first portion defining a first surface extending between a first pair of axially extending edges, said second portion defining a second surface extending between a second pair of axially extending edges; and wherein said first and second pairs of axially extending edges are disposed in a spaced relationship to define a gap therebetween when said first and second surfaces are engaged against said exterior of said vessel.

* * * * *

UNITED STATES PATENT AND TRADEMARK OFFICE

CERTIFICATE OF CORRECTION

PATENT NO. : 6,443,216 B1
DATED : September 3, 2002
INVENTOR(S) : Patrick J. Lombard et al.

It is certified that error appears in the above-identified patent and that said Letters Patent is hereby corrected as shown below:

Title page,
Item [56], U.S. PATENT DOCUMENTS, please insert

| | | | |
|---|---|---|---|
| -- 3,840,364 | 10/1974 | Flemings et al. | 75/63 |
| 3,842,895 | 10/1974 | Mehrabian et al. | 164/49 |
| 3,882,923 | 5/1975 | Adberny et al. | 164/250 |
| 3,902,544 | 9/1975 | Flemings et al. | 164/71 |
| 3,948,650 | 4/1976 | Flemings et al. | 75/135 |
| 3,951,651 | 4/1976 | Mehrabian et al. | 75/135 |
| 3,995,678 | 12/1976 | Zavaras et al. | 164/49 |
| 4,089,680 | 5/1978 | Flemings et al. | 75/129 |
| 4,108,643 | 8/1978 | Flemings et al. | 75/135 |
| 4,125,364 | 11/1978 | Stephens | 432/145 |
| 4,174,214 | 11/1979 | Bennett et al. | 75/168 |
| 4,229,210 | 10/1980 | Winter et al. | 75/10 |
| 4,321,954 | 3/1982 | Delassus | 164/504 |
| 4,345,637 | 8/1982 | Flemings et al. | 164/113 |
| 4,415,374 | 11/1983 | Young et al. | 148/2 |
| 4,434,837 | 3/1984 | Winter et al. | 164/468 |
| 4,450,893 | 5/1984 | Winter et al. | 164/468 |
| 4,457,354 | 7/1984 | Dantzig et al. | 164/468 |
| 4,457,355 | 7/1984 | Winter et al. | 164/468 |
| 4,465,118 | 8/1984 | Dantzig et al. | 164/452 |
| 4,482,012 | 11/1984 | Young et al. | 165/146 |
| 4,494,461 | 1/1985 | Pryor et al. | 102/464 |
| 4,523,624 | 6/1985 | Dantzig et al. | 164/454 |
| 4,524,820 | 6/1985 | Gullotti et al. | 164/476 |
| 4,530,404 | 7/1985 | Vives | 164/467 |
| 4,555,272 | 11/1985 | Ashok et al. | 148/3 |
| 4,565,241 | 1/1986 | Young | 164/499 |
| 4,569,218 | 2/1986 | Baker et al. | 72/342 |
| 4,607,682 | 8/1986 | Dantzig et al. | 164/418 |
| 4,614,225 | 9/1986 | Ernst et al. | 164/504 |
| 4,709,746 | 12/1987 | Young et al. | 164/485 |
| 4,712,413 | 12/1987 | Koch | 72/361 |
| RE 32,529 | 10/1987 | Vives | 164/467 |
| 4,729,422 | 3/1988 | Ernst et al. | 164/468 |
| 4,838,988 | 6/1989 | Lang et al. | 156/624 |

UNITED STATES PATENT AND TRADEMARK OFFICE

CERTIFICATE OF CORRECTION

PATENT NO. : 6,443,216 B1
DATED : September 3, 2002
INVENTOR(S) : Patrick J. Lombard et al.

It is certified that error appears in the above-identified patent and that said Letters Patent is hereby corrected as shown below:

| | | | |
|---|---|---|---|
| 4,877,079 | 10/1989 | Long et al. | 164/468 |
| 5,098,487 | 3/1992 | Brauer et al. | 148/432 |
| 5,135,564 | 8/1982 | Fujikawa et al. | 75/10.14 |
| 5,219,018 | 6/1993 | Meyer | 164/468 |
| 5,529,391 | 6/1996 | Kindman et al. | 366/145 |
| 5,549,732 | 8/1996 | Dube et al. | 75/331 |
| 5,585,067 | 12/1996 | Leroy et al. | 420/554 |
| 5,630,466 | 5/1997 | Garat et al. | 164/457 |
| 5,701,942 | 12/1997 | Adachi et al. | 164/711 |
| 5,899,567 | 5/1999 | Morris, Jr. | 366/274 |
| 5,900,080 | 5/1999 | Baldi et al. | 148/550 |
| 5,925,199 | 7/1999 | Shiina et al. | 148/538 |
| 6,003,590 | 12/1999 | Pavlicevic et al. | 164/468 |
| 6,021,842 | 2/2000 | Bulhoff et al. | 164/504 |
| 6,065,526 | 5/2000 | Kono | 164/113 |
| 6,165,411 | 12/200 | Adachi | 266/135 -- |

FOREIGN PATENT DOCUMENTS, please insert

| | | |
|---|---|---|
| -- JP | 1-192446 | 8/1989 |
| PCT | WO 98/30346 | 7/1998 |
| EP | EP 0903193 A1 | 3/1999 |
| EP | EP 0841406 A1 | 5/1998 |
| EP | EP 0745694 A1 | 12/1996 |
| EP | EP 0701022 A1 | 3/1996 |
| PCT | WO 95/19237 | 7/1995 |
| EP | EP 0710515 A1 | 5/1996 |
| PCT | WO 98/23403 | 6/1998 |
| PCT | WO 00/05015 | 2/2000 |
| PCT | WO 99/50007 | 10/1999 -- |

UNITED STATES PATENT AND TRADEMARK OFFICE

CERTIFICATE OF CORRECTION

PATENT NO. : 6,443,216 B1 
DATED : September 3, 2002
INVENTOR(S) : Patrick J. Lombard et al.

It is certified that error appears in the above-identified patent and that said Letters Patent is hereby corrected as shown below:

Item [56], cont'd,
At the end of FOREIGN PATENT DOCUMENTS, please insert

-- OTHER PUBLICATIONS
*Semisolid Metal Process Eliminates Preformed Billets*, Samuel D. Norville, Die Casting Management, March 1998, pgs. 31-33. --

Column 13,
Line 43, please change "$\alpha a_j$" to -- $\alpha_j$ --.

Column 21,
Line 6, please change "jackets" to -- jacket --.

Column 23,
Line 11, please change "actuator" to -- actuators --.

Signed and Sealed this

Twelfth Day of August, 2003

JAMES E. ROGAN
*Director of the United States Patent and Trademark Office*